United States Patent [19]

Stevens

[11] 4,355,986

[45] Oct. 26, 1982

[54] OUTBOARD MOTOR WITH ELEVATED HORIZONTAL PIVOT AXIS

[75] Inventor: Myron T. Stevens, Kenosha, Wis.

[73] Assignee: Outboard Marine Corporation, Waukegan, Ill.

[21] Appl. No.: 159,480

[22] Filed: Jun. 16, 1980

[51] Int. Cl.[3] ..... B63H 21/26

[52] U.S. Cl. ..... 440/53; 248/640; 248/642

[58] Field of Search ..... 440/52, 53, 55, 56, 440/57, 62, 65, 38, 39, 40, 41, 42, 43, 44, 45, 46, 47; 248/640, 641, 642, 643

[56] References Cited

U.S. PATENT DOCUMENTS

| | | | |
|---|---|---|---|
| 2,138,600 | 11/1938 | Harmon | 248/641 |
| 2,739,561 | 3/1956 | Kiekhaefer | 440/55 |
| 3,033,500 | 5/1962 | Graves | 248/641 |
| 3,139,062 | 6/1964 | Keefe | 115/18 R |
| 3,269,351 | 8/1966 | Shimanckas | 440/65 |
| 3,576,173 | 4/1971 | Ginnow | 440/55 |
| 3,613,631 | 10/1971 | Wick | 440/53 |
| 4,177,747 | 12/1979 | Pichl | 440/53 |

OTHER PUBLICATIONS

Leaflet R-120 Outboard.

*Primary Examiner*—Sherman D. Basinger
*Assistant Examiner*—Stephen P. Avila
*Attorney, Agent, or Firm*—Michael, Best & Friedrich

[57] ABSTRACT

Disclosed herein is an outboard motor comprising a transom bracket adapted to be fixed to a boat transom and having a generally flat mounting surface for engagement with the back of the transom, a swivel bracket, a pivot on the swivel bracket and on the transom bracket rearwardly of the mounting surface for pivotally connecting the swivel bracket and the transom bracket for tilting movement between a normal operating position and a raised tilt position and about a tilt axis which is generally horizontal when the transom bracket is fixed to the boat transom, a propulsion unit including a powerhead and a lower unit rigidly secured to the powerhead, and a pivot connected to the propulsion unit and located below the powerhead and connected to the swivel bracket for pivotally connecting the propulsion unit and the swivel bracket for steering movement about an axis transverse to the tilt axis and such that the propulsion unit remains rearwardly of the plane of the transom bracket mounting surface throughout movement of the swivel bracket from the normal operating position to the tilt position.

40 Claims, 1 Drawing Figure

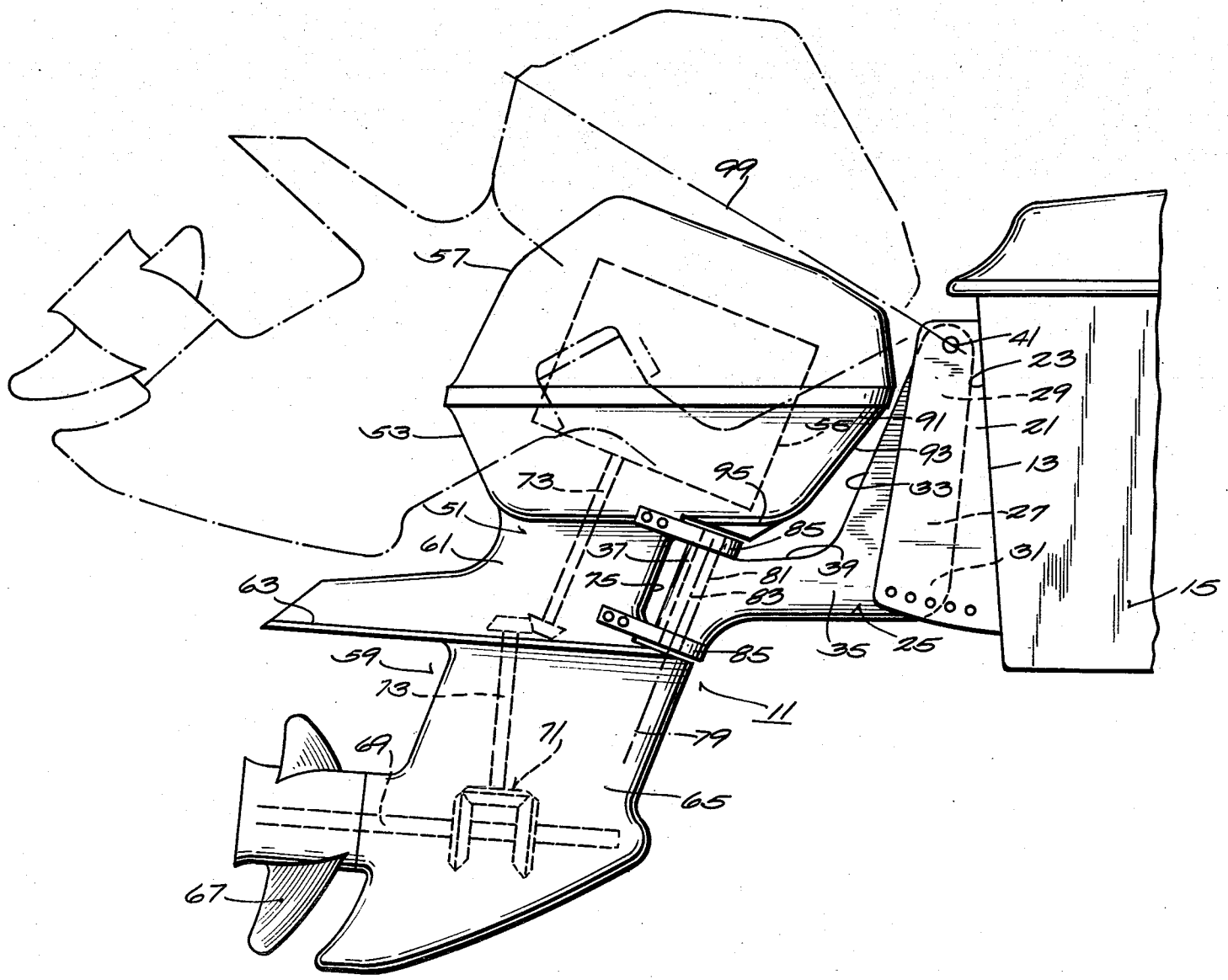
15
41
23
29
21
13
27
31
91
93
33
25
35
39
99
56
95
85
81
83
85
11
79
65
37
75
73
71
57
51
61
53
59
73
69
63
67

OUTBOARD MOTOR WITH ELEVATED HORIZONTAL PIVOT AXIS

BACKGROUND OF THE INVENTION

The invention related generally to marine propulsion devices, and particularly to outboard motors in which the powerhead is both tiltable and steerable relative to the boat hull.

Examples of prior outboard motors including tiltable and steerable powerheads are disclosed in the Irgens U.S. Pat. No. 2,732,819 issued Jan. 31, 1956, in the Kiefkhaefer U.S. Pat. No. 2,739,561 issued Mar. 27, 1956, in the Shimanckas U.S. Pat. No. 3,269,351 issued Aug. 30, 1966, and in the Ginnow U.S. Pat. No. 3,576,173 issued Apr. 27, 1971.

SUMMARY OF THE INVENTION

The invention provides an outboard motor comprising a transom bracket adapted to be fixed to a boat transom and having a generally flat mounting surface for engagement with the back of the transom, a swivel bracket, means on the swivel bracket and on the transom bracket rearwardly of the mounting surface for pivotally connecting the swivel bracket and the transom bracket for tilting movement between a normal operating position and a raised tilt position and about a tilt axis which is generally horizontal when the transom bracket is fixed to the boat transom, a propulsion unit including a powerhead and a lower unit rigidly secured to the powerhead, and means connected to said propulsion unit and to the swivel bracket for providing pivotal steering movement of the propulsion unit relative to the swivel bracket about an axis transverse to the tilt axis and such that the propulsion unit remains rearwardly of the plane of the transom bracket mounting surface throughout movement of the swivel bracket from the normal operating position to the tilt position.

The invention further provides an outboard motor comprising a transom bracket adapted to be fixed to a boat transom and having generally flat mounting surface for engagement with the back of the transom, a swivel bracket including a vertical leg having an upper end, a rearward surface extending below the upper end, and a lower end, and a lower leg extending rearwardly from the lower end of the vertical leg and having an outer rearward end spaced substantially from the lower end of the vertical leg and an upper surface extending forwardly from the rearward end and located substantially below the upper end of the swivel bracket, means on the upper end of the swivel bracket and on the transom bracket rearwardly of the mounting surface for pivotally connecting the swivel bracket and the transom bracket for tilting movement between a normal operating position and a raised tilt position and about a tilt axis which is generally horizontal when the transom bracket is fixed to the board transom, a propulsion unit including a powerhead having a forward portion with front and bottom surfaces, and a lower unit rigidly secured to the powerhead rearwardly of the bottom surface of the forward portion of the powerhead and including a gearcase, and means connected to the propulsion unit and located between the powerhead and the gearcase and connected to the rearward end of the lower leg of the swivel bracket for pivotally connecting the propulsion unit and the swivel bracket for steering movement about an axis transverse to the tilt axis and with the front surface of the forward portion of the powerhead located primarily below the tilt axis and in rearwardly spaced relation from the rearward surface of the vertical leg of the swivel bracket and with the bottom surface of the forward portion of the powerhead located in upwardly spaced relation from the upper surface of the lower leg of the swivel bracket and such that the propulsion unit remains rearwardly of the plane of the transom bracket mounting surface throughout movement of the swivel bracket from the normal operating position to the tilt position.

The invention also provides an outboard motor comprising a transom bracket adapted to be fixed to a boat transom and having a generally flat mounting surface for engagement with the transom, a swivel bracket including a vertical leg having an upper end, and a lower end, and a lower leg extending rearwardly from the lower end of the vertical leg, means on the upper end of the swivel bracket and on the transom bracket for pivotally connecting the swivel bracket and the transom bracket for tilting movement between a normal operating position and a raised tilt position and about a tilt axis which is generally horizontal when the transom bracket is fixed to the boat transom, a propulsion unit including a powerhead and a lower unit rigidly secured to the powerhead, and means connected to the propulsion unit and located below the powerhead and connected to the lower leg of the swivel bracket for pivotally connecting the propulsion unit and the swivel bracket for steering movement about an axis transverse to the tilt axis and for locating the powerhead substantially wholly rearwardly of the tilt axis and with at least one-half of the powerhead located below the tilt axis such that the propulsion unit remains rearwardly of the plane of the transom bracket mounting surface throughout movement of the swivel bracket from the normal operating position to the tilt position.

Other features and advantages of the embodiments of the invention will become known by reference to the following general description, claims and appended drawings.

IN THE DRAWINGS

FIG. 1 is a side elevational view of an outboard motor embodying various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in the drawings is a marine propulsion device which is in the form of an outboard motor 11, which is illustrated in mounted condition on the back of a transom 13 of a boat 15, and which is arranged for upward tilting movement through the tilt range so as to avoid position of any substantial part of the outboard motor forwardly of the transom.

More particularly, the outboard motor 11 includes a transom bracket 21 which can be of generally conventional construction, which is adapted to be suitably fixed to the board transom 13, as by bolts or otherwise, and which has a generally flat mounting surface 23 for engagement with the back of the boat transom 13.

Also includes in the outboard motor is a second or unitary swivel bracket 25 which, in general, is "L" shaped, including a vertical leg 27 having upper and lower ends 29 and 31, respectively, and a rearward generally vertical surface 33 extending below the upper end 29, together with a lower leg or arm 35 which extends rearwardly of the lower end 31 of the vertical leg 27, which includes an outer or rearward end 37 spaced substantially from the rearward surface 33 or lower end 31 of the vertical leg 27, and which includes an upper surface 39 which extends from the outer rearward end 37 to the rearward surface 33 of the vertical leg 27 and which is located substantially below the upper end 29 of the swivel bracket vertical leg 27.

Means are provided on the upper end 29 of the swivel bracket 25 and on the transom bracket 21 for pivotally connecting the swivel bracket 25 and the transom bracket 21 for swivel bracket tilting movement about a tilt axis 41 relative to the transom bracket 21 between a normal running position as shown in full lines and a raised tilt position as shown in dotted outline. When the transom bracket 25 is attached to the boat transom 13, the tilt axis 41 of such movement is generally horizontal. Various known commercial arrangements can be employed for tiltably connecting the swivel and transom brackets 21 and 25, as for instance, a tilt tube which extends through mating apertures in the transom and swivel brackets.

In addition, the swivel bracket 25 and transom bracket 21 can be provided with conventional means for adjusting the trim of the swivel bracket 25 relative to the transom bracket 21 so as to accommodate variations in the angle of the boat transom, for providing a reverse lock, and/or for providing power trimming and/or tilting.

Also included in the outboard motor 11 is a propulsion unit 51 which can be generally of conventional construction except as noted herein and as shown in the drawing. More particularly, the propulsion 51 unit includes a powerhead 53 including an internal combustion engine 55 and a cover 57 therefor. In addition, the propulsion unit 51 includes a lower unit 59 which is rigidly connected to the powerhead 53 and which includes a driveshaft housing 61 terminating, at its lower end, with a cavitation plate 63, and with a gear case or box portion 65 which is connected to the driveshaft housing 61 and located below the cavitation plate 63 and which supports a propeller 67 carried by a propeller shaft 69. As is conventional, the propeller shaft 69 is connected through a gear transmission 71 with a drive train 73 which extends from the engine crankshaft. When the propulsion unit 51 is connected to the swivel bracket 25, as will be explained, and when the outboard motor 11 is mounted on the boat transom 13 and located in the normal running or operating position, the cavitation plate 63 is located, as shown, at about the same level as the bottom of the central part of the boat transom 13.

As shown, the driveshaft housing 61 is of considerably reduced height, as compared to prior commercial construction, and is connected to the rearward portion of the powerhead 53. In addition, the gear case 65 extends considerably forwardly of the driveshaft housing 61, thereby providing a recess 75 which is located between the gearcase 65 and powerhead 53 and which receives the outer rearward end 37 of the swivel bracket 25. Preferably, the driveshaft 73 is inclined upwardly and forwardly with the propulsion unit 51 having a similar inclined construction. In the construction illustrated, the drive shaft 73 extends upwardly and forwardly at an angle of about 70° to the horizontal. In other words, the drive shaft 73 extends downwardly and rearwardly at an angle of about 20° to the vertical.

Means 75 are provided on the lower unit 59 between the powerhead 53 and the gearcase 65 or cavitation plate 63 and on the rearward end 37 of the lower leg 35 of the swivel bracket 25 for pivotally connecting the propulsion unit 51 and the swivel bracket 25 for pivotal movement of the propulsion unit 51 relative to the swivel bracket 25 about a steering axis 79 which is transverse to the tilt axis 41 and generally parallel to and forwardly of the drive shaft 73. Various arrangements can be employed. For instance, the rearward outer end 37 of the swivel bracket 25 can be provided with an vertically inclined bore 81 receiving a kingpin 83 which, at its upper and lower ends, projects outwardly from the bore 81 and has attached thereto upper and lower arms 85 which extend rearwardly and are attached to the drive shaft housing 61 so as to support the propulsion unit 51 from swivel bracket 25.

Alternatively, the kingpin 83 could be received in suitable sockets (not shown) within or on the gearcase 65 and powerhead 53.

When the propulsion unit 51 is assembled to the swivel bracket 25, the powerhead 53 is so located that the forward portion 91 thereof has a forward surface 93 which is located principally totally below the tilt axis 41 and in rearwardly spaced relation from the rearward surface 33 of the swivel bracket vertical leg 27. In addition, the forward portion 91 of the powerhead 53 includes a lower or bottom surface 95 which is located in upwardly spaced relation from the upper surface 39 of the lower leg 35 of the swivel bracket 25.

Any suitable means connected to the propulsion unit 51 can be employed for steering displacement of the propulsion unit 51 relative to the swivel bracket 25.

It is especially noted that substantially more than one-half of the bulk of the powerhead 53 is located below the tilt axis 41 and that the area, defined between a line 99 passing upwardly and rearwardly through the tilt axis 41 and intersecting the plane of the mounting surface 33 at an angle of about 55°, is clear or free of the powerhead 53. It is also especially noted that essentially the entire powerhead 53 is located rearwardly of the tilt axis 41. In addition, the tilt axis 41 is located rearwardly of the transom 13 and no part of the propulsion unit 51 or swivel bracket 25 extends forwardly over the transom 13 when the outboard motor is in a normal running position.

The result of this general arrangement is that the propulsion unit 51 can be swung upwardly through an angle of about 45° so as to locate the gearcase 65 out of the water and the driveshaft 73 at an angle of about 25° to the horizontal, without locating any material part of the propulsion unit 51 or swivel bracket 25 forwardly of the plane of the transom bracket mounting surface 23. Accordingly, outboard motors of the configuration described can be mounted on boats constructed with a full transom, i.e., without the customary upwardly open cutout or notch, and on boats constructed without a motor well forwardly of the transom. As a result, and as compared to inboard and stern drive units, additional interior room is provided as the entire interior space of the boat is available for use by the occupants or users.

Still further, the disclosed construction can be employed with boats having relatively high transoms, thereby serving to keep water out of the boat when traveling in reverse and in high seas.

Various features of the invention are set forth in the following claims.

I claim:

1. An outboard motor comprising a transom bracket adapted to be fixed to the transom of a boat and having a mounting surface for engagement with the back of the transom, a unitary swivel bracket, a tilt pin directly pivotally connecting said transom bracket and said swivel bracket rearwardly of said mounting surface for tilting movement of said swivel bracket between a normal operating position and a raised tilt position and about a tilt axis which is generally horizontal when said transom bracket is fixed to the boat transom, a propulsion unit including a powerhead and a lower unit secured to said powerhead, and means connecting said propulsion unit to said swivel bracket so as to enable pivotal steering movement of said propulsion unit relative to said swivel bracket about an axis transverse to the tilt axis, and such that said propulsion unit only pivots about the transverse axis with respect to said swivel bracket, and such that said propulsion unit remains substantially rearwardly of said transom bracket mounting surface throughout movement of said swivel bracket from the normal operating position to the tilt position, and such that the totality of said means connecting said propulsion unit and said swivel bracket is wholly located below the tilt axis.

2. An outboard motor in accordance with claim 1 wherein said propulsion unit extends at a forward and upward incline to the horizontal.

3. An outboard motor comprising a transom bracket adapted to be fixed to the transom of a boat and having a mounting surface for engagement with the transom, a swivel bracket including a vertical leg having an upper end, and a lower end, and a lower leg fixedly extending rearwardly from said lower end of said vertical leg, a tilt pin extending between said upper end of said swivel bracket and said transom bracket so as to pivotally connect said swivel bracket and said transom bracket for tilting movement of said swivel bracket between a normal operating position and a raised tilt position and about a tilt axis which is generally horizontal when said transom bracket is fixed to the boat transom, a propulsion unit including a powerhead and a lower unit secured to said powerhead, and means connecting said lower unit and said lower leg of said swivel bracket so as to enable steering movement of said propulsion unit about an axis transverse to the tilt axis, and such that said propulsion unit only pivots about the transverse axis with respect to said swivel bracket and such that said powerhead is located substantially wholly rearwardly of said tilt axis, and such that at least one-half of said powerhead is located below said tilt axis, and such that said propulsion unit remains substantially rearwardly of said transom bracket mounting surface throughout movement of said swivel bracket from the normal operating position to the tilt position, and such that the totality of said means connecting said propulsion unit and said swivel bracket is wholly located below the tilt axis.

4. An outboard motor in accordance with claim 3 wherein said propulsion unit extends at a forward and upward incline to the horizontal.

5. An outboard motor comprising a transom bracket adapted to be fixed to the transom of a boat and having a mounting surface for engagement with the back of the transom, a unitary swivel bracket, a tilt pin directly pivotally connecting said swivel bracket and said transom bracket rearwardly of said mounting surface for tilting movement of said swivel bracket between a normal operating position and a raised tilt position and about a tilt axis which is generally horizontal when said transom bracket is fixed to the boat transom, a propulsion unit including a powerhead and a lower unit secured to said powerhead, and means connected to said propulsion unit and to said swivel bracket so as to enable pivotal steering movement of said propulsion unit relative to said swivel bracket for steering movement of said propulsion unit about an axis transverse to the tilt axis, and such that said propulsion unit only pivots about the transverse axis with respect to said swivel bracket, and such that said powerhead is located substantially wholly rearwardly of said tilt axis, and such that at least one-half of said powerhead is located below said tilt axis, and such that said propulsion unit remains substantially rearwardly of said transom bracket mounting surface throughout movement of said swivel bracket from the normal operating position to the tilt position, and such that the totality of said means connecting said propulsion unit and said swivel bracket is wholly located below the tilt axis.

6. An outboard motor in accordance with claim 5 wherein said propulsion unit extends at a forward and upward incline to the horizontal.

7. An outboard motor comprising a transom bracket adapted to be fixed to the transom of a boat and having a generally flat mounting surface for engagement with the back of the transom, a swivel bracket including a vertical leg having an upper end, a rearward surface extending below said upper end, and a lower end, and a lower leg fixedly extending rearwardly from said lower end of said vertical leg and having an outer rearward end spaced substantially from said lower end of said vertical leg and an upper surface extending forwardly from said rearward end and located substantially below said upper end of said swivel bracket, a tilt pin extending between said upper end of said swivel bracket and said transom bracket rearwardly of said mounting surface so as to pivotally connect said swivel bracket and said transom bracket for tilting movement of said swivel bracket between a normal operating position and a raised tilt position and about a tilt axis which is generally horizontal when said transom bracket is fixed to the boat transom, a propulsion unit including a powerhead having a forward portion with front and bottom surfaces, and a lower unit secured to said powerhead rearwardly of said bottom surface of said forward portion of said powerhead and including a gearcase, and means connected to said propulsion unit between said powerhead and said gearcase and connected to said rearward end of said lower leg of said swivel bracket for pivotally connecting said propulsion unit and said swivel bracket so as to enable steering movement of said propulsion unit about an axis transverse to the tilt axis, and such that said propulsion unit only pivots about the transverse axis with respect to said swivel bracket, and such that said front surface of said forward portion of said powerhead is located primarily below the tilt axis and in rearwardly spaced relation from said rearward surface of said vertical leg of said swivel bracket, and such that said bottom surface of said forward portion of said powerhead is located in upwardly spaced relation from said upper surface of said lower leg of said swivel bracket, and such that said propulsion unit remains substantially rearwardly of the plane of said transom bracket mounting surface throughout movement of said swivel bracket from the normal operating position to the tilt position, and such the totality of said means connecting said propulsion unit and said swivel bracket is wholly located below the tilt axis.

8. An outboard motor in accordance with claim 7 wherein said propulsion unit extends at a forward and upward incline to the horizontal.

9. An outboard motor comprising a transom bracket adapted to be fixed to the transom of a boat, a unitary swivel bracket, a tilt pin directly pivotally connecting said swivel bracket and said transom bracket rearwardly of the transom for tilting movement of said swivel bracket relative to said transom bracket between a normal operating position and a raised tilt position and about a tilt axis which is generally horizontal when said transom bracket is fixed to the boat transom, a propulsion unit including a lower unit and a powerhead secured to said lower unit below the tilt axis, and means connecting said propulsion unit and said swivel bracket so as to enable pivotal steering movement of said propulsion unit relative to said swivel bracket about an axis transverse to the tilt axis, and such that said propulsion unit only pivots about the transverse axis with respect to said swivel bracket, and such that the totality of said means connecting said propulsion unit and said swivel bracket is wholly located below the tilt axis.

10. An outboard motor comprising a transom bracket adapted to be fixed to the transom of a boat, a unitary swivel bracket, a tilt pin directly pivotally connecting said swivel bracket and said transom bracket rearwardly of the transom for tilting movement of said swivel bracket relative to said transom bracket between a normal operating position and a raised tilt position and about a tilt axis which is generally horizontal when said transom bracket is fixed to the boat transom, a propulsion unit including a powerhead and a lower unit secured to said powerhead, and means connecting said propulsion unit and said swivel bracket so as to enable pivotal steering movement of said propulsion unit relative to said swivel bracket about an axis transverse to the tilt axis, and such that said propulsion unit only pivots about the transverse axis with respect to said swivel bracket, and such that the totality of said means connecting said propulsion unit and said swivel bracket is wholly located below the tilt axis.

11. An outboard motor comprising a transom bracket adapted to be fixed to the transom of a boat, a unitary swivel bracket, a tilt pin directly pivotally connecting said swivel bracket and said transom bracket rearwardly of the transom for tilting movement of said swivel bracket relative to said transom bracket between a normal operating position and a raised tilt position and about a tilt axis which is generally horizontal when said transom bracket is fixed to the boat transom, a propulsion unit including a powerhead and a lower unit secured to said powerhead, and means connecting said lower unit and said swivel bracket so as to enable pivotal steering movement of said propulsion unit relative to said swivel bracket about an axis transverse to the tilt axis, and such that said propulsion unit only pivots about the transverse axis with respect to said swivel bracket, and such that the totality of said means connecting said propulsion unit and said swivel bracket is wholly located below the tilt axis.

12. An outboard motor comprising a transom bracket adapted to be fixed to the transom of a boat, a unitary swivel bracket, a tilt pin directly pivotally connecting said swivel bracket and said transom bracket rearwardly of the transom for tilting movement of said swivel bracket relative to said transom bracket between a normal operating position and a raised tilt position and about a tilt axis which is generally horizontal when said transom bracket is fixed to the boat transom, a propulsion unit including a powerhead and a lower unit secured to said powerhead, and means connected between said swivel bracket and said propulsion unit so as to enable pivotal steering movement of said propulsion unit relative to said swivel bracket about an axis transverse to the tilt axis, and such that said propulsion unit only pivots about the transverse axis with respect to said swivel bracket, and such that the totality of said means connecting said propulsion unit and said swivel bracket is wholly located below the tilt axis.

13. An outboard motor comprising a transom bracket adapted to be fixed to the transom of a boat, a unitary swivel bracket, a tilt pin directly pivotally connecting said swivel bracket and said transom bracket rearwardly of the transom for tilting movement of said swivel bracket relative to said transom bracket between a normal operating position and a raised tilt position and about a tilt axis which is generally horizontal when said transom bracket is fixed to the boat transom, a propulsion unit including a powerhead and a lower unit secured to said powerhead, and means connecting said propulsion unit and said swivel bracket so as to enable pivotal steering movement of said propulsion unit relative to said swivel bracket about an axis transverse to the tilt axis, and such that said propulsion unit only pivots about the transverse axis with respect to said swivel bracket, and such that at least one half of said powerhead is located below the tilt axis when said swivel bracket is in a normal operating position, and such that the totality of said means connecting said propulsion unit and said swivel bracket is wholly located below the tilt axis.

14. A marine propulsion arrangement comprising a transom bracket adapted to be fixed to the transom of a boat, a second bracket including a vertical leg having an upper end and a lower end, and a lower leg fixedly extending rearwardly from said lower end of said vertical leg and having an outer rearward end spaced substantially from said lower end of said vertical leg, a tilt pin extending between said upper end of said second bracket and said transom bracket rearwardly of the transom so as to pivotally connect said second bracket and said transom bracket and tilting movement of said second bracket between a normal operating position and a raised tilt position and about a tilt axis which is generally horizontal when said transom bracket is fixed to the boat transom, a propulsion unit including a powerhead and a lower unit secured to said powerhead and including a gearcase carrying a propulsion element, and means connecting said propulsion unit to said rearward end of said lower leg of said second bracket so as to enable steering movement of said propulsion unit relative to said second bracket about an axis transverse to the tilt axis, and such that said propulsion unit only pivots about the transverse axis with respect to said second bracket, and such that the totality of said means connecting said propulsion unit and said second bracket is wholly located below the tilt axis.

15. A marine propulsion arrangement comprising of a transom bracket adapted to be fixed to the transom of a boat, a second bracket including a vertical leg having an upper end and a lower end, and a lower leg fixedly extending rearwardly from said lower end of said vertical leg and having an outer rearward end spaced substantially from said lower end of said vertical leg, a tilt pin extending between said upper end of said second bracket and said transom bracket rearwardly of the transom so as to pivotally connect said second bracket and said transom bracket for tilting movement of said second bracket between a normal operating position and a raised tilt position and about a tilt axis which is generally horizontal when said transom bracket is fixed to the boat transom, a propulsion unit including a powerhead having a forward portion with front and bottom surfaces, and a lower unit secured to said powerhead rearwardly of said bottom surface of said forward portion of said powerhead and including a gearcase carrying a propulsion element, and means connecting said propulsion unit to said rearward end of said lower leg of said second bracket so as to enable steering movement of said propulsion unit relative to said second bracket about an axis transverse to the tilt axis, and such that said propulsion unit only pivots about the transverse axis with respect to said second bracket, and such that said front surface of said forward portion of said powerhead is located primarily below said tilt axis and in rearwardly spaced relation from said vertical leg of said second bracket, and such that said bottom surface of said forward portion of said powerhead is located in upwardly spaced relation from said lower leg of said second bracket, and such that the totality of said means connecting said propulsion unit and said second bracket is wholly located below the tilt axis.

16. A marine propulsion arrangement comprising a transom bracket adapted to be fixed to the transom of a boat, a second bracket including a vertical leg having an upper end, a rearward surface extending below said upper end, and a lower end, and a lower leg fixedly extending rearwardly from said lower end of said vertical leg and having an outer rearward end spaced substantially from said lower end of said vertical leg and an upper surface extending forwardly from said rearward end and located substantially below said upper end of said second bracket, a tilt pin extending between said upper end of said second bracket and said transom bracket rearwardly of the transom so as to pivotally connect said second bracket and said transom bracket for tilting movement of said second bracket between a normal operating position and a raised tilt position and about a tilt axis which is generally horizontal when said transom bracket is fixed to the boat transom, a propulsion unit including a powerhead having a forward portion with front and bottom surfaces, and a lower unit secured to said powerhead rearwardly of said bottom surface of said forward portion of said powerhead and including a gearcase carrying a propulsion element, and means connecting said propulsion unit to said rearward end of said lower leg of said second bracket so as to enable steering movement of said propulsion unit relative to said second bracket about an axis transverse to the tilt axis, and such that said propulsion unit only pivots about the transverse axis with respect to said second bracket, and such that said front surface of said forward portion of said powerhead is located primarily below said tilt axis and in rearwardly spaced relation from said rearward surface of said vertical leg of said second bracket, and such that said bottom surface of said forward portion of said powerhead is located in upwardly spaced relation from said upper surface of said lower leg of said second bracket, and such that the totality of said means connecting said propulsion unit and said second bracket is wholly located below the tilt axis.

17. An outboard motor comprising a transom bracket adapted to be fixed to the transom of a boat and having a mounting surface for engagement with the back of the transom, a unitary swivel bracket, a tilt pin directly pivotally connecting said transom bracket and said swivel bracket rearwardly of said mounting surface for tilting movement of said swivel bracket between a normal operating position and a raised tilt position and about a tilt axis which is generally horizontal when said transom bracket is fixed to the boat transom, a propulsion unit including a powerhead and a lower unit secured to said powerhead, and means connecting said propulsion unit to said swivel bracket so as to enable pivotal steering movement of said propulsion unit relative to said swivel bracket about an axis transverse to the tilt axis, and such that said propulsion unit only pivots about the transverse axis with respect to said swivel bracket, and such that said propulsion unit remains substantially rearwardly of said transom bracket mounting surface throughout movement of said swivel bracket from the normal operating position to the tilt position, and such that the totality of said means connecting said propulsion unit and said swivel bracket is wholly located below said powerhead.

18. An outboard motor comprising a transom bracket adapted to be fixed to the transom of a boat and having a mounting surface for engagement with the transom, a swivel bracket including a vertical leg having an upper end, and a lower end, and a lower leg fixedly extending rearwardly from said lower end of said vertical leg, a tilt pin extending between said upper end of said swivel bracket and said transom bracket so as to pivotally connect said swivel bracket and said transom bracket for tilting movement of said swivel bracket between a normal operating position and a raised tilt position and about a tilt axis which is generally horizontal when said transom bracket is fixed to the boat transom, a propulsion unit including a powerhead and a lower unit secured to said powerhead, and means connecting said lower unit and said lower leg of said swivel bracket so as to enable steering movement of said propulsion unit about an axis transverse to the tilt axis, and such that said propulsion unit only pivots about the transverse axis with respect to said swivel bracket, and such that powerhead is located substantially wholly rearwardly of said tilt axis, and such that at least one-half of said powerhead is located below said tilt axis, and such that said propulsion unit remains substantially rearwardly of said transom bracket mounting surface throughout movement of said swivel bracket from the normal operating position to the tilt position and such that the totality of said means connecting said propulsion unit and said swivel racket is wholly located below said powerhead.

19. An outboard motor comprising a transom bracket adapted to be fixed to the transom of a boat and having a mounting surface for engagement with the back of the transom, a unitary swivel bracket, a tilt pin directly pivotally connecting said swivel bracket and said transom bracket rearwardly of said mounting surface for tilting movement of said swivel bracket between a normal operating position and a raised tilt position and about a tilt axis which is generally horizontal when said transom bracket is fixed to the boat transom, a propulsion unit including a powerhead and a lower unit rigidly secured to said powerhead, and means connecting said propulsion unit and said swivel bracket so as to enable steering movement of said propulsion unit about an axis transverse to the tilt axis, and such that said propulsion unit only pivots about the transverse axis with respect to said swivel bracket, and such that said powerhead is located substantially wholly rearwardly of said tilt axis, and such that at least one-half of said powerhead is located below said tilt axis, and such that said propulsion unit remains substantially rearwardly of said transom bracket mounting surface throughout movement of said swivel bracket from the normal operating position to the tilt position, and such that the totality of said means connecting said propulsion unit and said swivel bracket is wholly located below said powerhead.

20. An outboard motor comprising a transom bracket adapted to be fixed to the transom of a boat and having a generally flat mounting surface for engagement with the back of the transom, a swivel bracket including a vertical leg having an upper end, a rearward surface extending below said upper end, and a lower end, and a lower leg fixedly extending rearwardly from said lower end of said vertical leg and having an outer rearward end spaced substantially from said lower end of said vertical leg and an upper surface extending forwardly from said rearward end and located substantially below said upper end of said swivel bracket, a tilt pin extending between said upper end of said swivel bracket and said transom bracket rearwardly of said mounting surface so as to pivotally connect said swivel bracket and said transom bracket for tilting movement of said swivel bracket between a normal operating position and a raised tilt position and about a tilt axis which is generally horizontal when said transom bracket is fixed to the boat transom, a propulsion unit including a powerhead having a forward portion with front and bottom surfaces, and a lower unit secured to said powerhead rearwardly of said bottom surface of said forward portion of said powerhead and including a gearcase, and means connected to said propulsion unit between said powerhead and said gearcase and connected to said rearward end of said lower leg of said swivel bracket for pivotally connecting said propulsion unit and said swivel bracket so as to enable steering movement of said propulsion unit about an axis transverse to the tilt axis, and such that said propulsion unit only pivots about the transverse axis with respect to said swivel bracket, and such that said front surface of said forward portion of said powerhead is located primarily below the tilt axis and in rearwardly spaced relation from said swivel bracket, and such that said bottom surface of said forward portion of said powerhead is located in upwardly spaced relation from said upper surface of said lower leg of said swivel bracket, and such that said propulsion unit remains substantially rearwardly of the plane of said transom bracket mounting surface throughout movement of said swivel bracket from the normal operating position to the tilt position, and such that the totality of said means connecting said propulsion unit and said swivel bracket is wholly located below said powerhead.

21. An outboard motor comprising a transom bracket adapted to be fixed to the transom of a boat, a unitary swivel bracket, a tilt pin directly pivotally connecting said swivel bracket and said transom bracket rearwardly of the transom for tilting movement of said swivel bracket relative to said transom bracket between a normal operating position and a raised tilt position and about a tilt axis which is generally horizontal when said transom bracket is fixed to the boat transom, a propulsion unit including a lower unit and a powerhead secured to said lower unit below the tilt axis, and means connecting said propulsion unit and said swivel bracket so as to enable pivotal steering movement of said propulsion unit relative to said swivel bracket about an axis transverse to the tilt axis, and such that said propulsion unit only pivots about the transverse axis with respect to said swivel bracket, and such that the totality of said means connecting said propulsion unit and said swivel bracket is wholly located below said powerhead.

22. An outboard motor comprising a transom bracket adapted to be fixed to the transom of a boat, a unitary swivel bracket, a tilt pin directly pivotally connecting said swivel bracket and said transom bracket rearwardly of the transom for tilting movement of said swivel bracket relative to said transom bracket between a normal operating position and a raised tilt position and about a tilt axis which is generally horizontal when said transom bracket is fixed to the boat transom, a propulsion unit including a powerhead and a lower unit secured to said powerhead, and means connecting said propulsion unit and said swivel bracket so as to enable pivotal steering movement of said propulsion unit relative to said swivel bracket about an axis transverse to the tilt axis, and such that said propulsion unit only pivots about the transverse axis with respect to said swivel bracket, and such that the totality of said means connecting said propulsion unit and said swivel bracket is wholly located below said powerhead.

23. An outboard motor comprising a transom bracket adapted to be fixed to the transom of a boat, a unitary swivel bracket, a tilt pin directly pivotally connecting said swivel bracket and said transom bracket rearwardly of the transom for tilting movement of said swivel bracket relative to said transom bracket between a normal operating position and a raised tilt position and about a tilt axis which is generally horizontal when said transom bracket is fixed to the boat transom, a propulsion unit including a powerhead and a lower unit secured to said powerhead, and means connecting said lower unit and said swivel bracket so as to enable pivotal steering movement of said propulsion unit relative to said swivel bracket about an axis transverse to the tilt axis, and such that said propulsion unit only pivots about the transverse axis with respect to said swivel bracket, and such that the totality of said means connecting said propulsion unit and said swivel bracket is wholly located below said powerhead.

24. An outboard motor comprising a transom bracket adapted to be fixed to the transom of a boat, a unitary swivel bracket, a tilt pin directly pivotally connecting said swivel bracket and said transom bracket rearwardly of the transom for tilting movement of said swivel bracket relative to said transom bracket between a normal operating position and a raised tilt position and about a tilt axis which is generally horizontal when said transom bracket is fixed to the boat transom, a propulsion unit including a powerhead and a lower unit secured to said powerhead, and means connected between said swivel bracket and said propulsion unit so as to enable pivotal steering movement of said propulsion unit relative to said swivel bracket about an axis transverse to the tilt axis, and such that said propulsion unit only pivots about the transverse axis with respect to said swivel bracket, and such that the totality of said means connecting said propulsion unit and said swivel bracket is wholly located below said powerhead.

25. An outboard motor comprising a transom bracket adapted to be fixed to the transom of a boat, a unitary swivel bracket, a tilt pin directly pivotally connecting said swivel bracket and said transom bracket rearwardly of the transom for tilting movement of said swivel bracket relative to said transom bracket between a normal operating position and a raised tilt position and about a tilt axis which is generally horizontal when said transom bracket is fixed to the boat transom, a propulsion unit including a powerhead and a lower unit secured to said powerhead, and means connecting said propulsion unit and said swivel bracket so as to enable pivotal steering movement of said propulsion unit relative to said swivel bracket about an axis transverse to the tilt axis, and such that said propulsion unit only pivots about the transverse axis with respect to said swivel bracket, and such that at least one-half of said powerhead is located below the tilt axis when said swivel bracket is in a normal operating position, and such that the totality of said means connecting said propulsion unit and said swivel bracket is wholly located below said powerhead.

26. A marine propulsion arrangement comprising a transom bracket adapted to be fixed to the transom of a boat, a second bracket including a vertical leg having an upper end and a lower end, and a lower leg fixedly extending rearwardly from said lower end of said vertical leg and having an outer rearward end spaced substantially from said lower end of said vertical leg, a tilt pin extending between said upper end of said second bracket and said transom bracket rearwardly of the transom so as to pivotally connect said second bracket and said transom bracket for tilting movement of said second bracket between a normal operating position and a raised tilt position and about a tilt axis which is generally horizontal when said transom bracket is fixed to the boat transom, a propulsion unit including a powerhead and a lower unit secured to said powerhead and including a gearcase carrying a propulsion element, and means connecting said propulsion unit to said rearward end of said lower leg of said second bracket so as to enable pivotal steering movement of said propulsion unit relative to said second bracket about an axis transverse to the tilt axis, and such that said propulsion unit only pivots about the transverse axis with respect to said second bracket, and such that the totality of said means connecting said propulsion unit and said second bracket is wholly located below said powerhead.

27. A marine propulsion arrangement comprising of a transom bracket adapted to be fixed to the transom of a boat, a second bracket including a vertical leg having an upper end and a lower end, and a lower leg fixedly extending rearwardly from said lower end of said vertical leg and having an outer rearward end spaced substantially from said lower end of said vertical leg, a tilt pin extending between said upper end of said second bracket and said transom bracket rearwardly of the transom so as to pivotally connect said second bracket and said transom bracket for tilting movement of said second bracket between a normal operating position and a raised tilt position and about a tilt axis which is generally horizontal when said transom bracket is fixed to the boat transom, a propulsion unit including a powerhead having a forward portion with front and bottom surfaces, and a lower unit secured to said powerhead rearwardly of said bottom surface of said forward portion of said powerhead and including a gearcase carrying a propulsion element, and means connecting said propulsion unit to said rearward end of said lower leg of said second bracket so as to enable steering movement of said propulsion unit relative to said second bracket about an axis transverse to the tilt axis, and such that said propulsion unit only pivots about the transverse axis with respect to said second bracket, and such that said front surface of said forward portion of said powerhead is located primarily below said tilt axis and in rearwardly spaced relation from said vertical leg of said second bracket, and such that said bottom surface of said forward portion of said powerhead is located in upwardly spaced relation from said lower leg of said second bracket, and such that the totality of said means connecting said propulsion unit and said second bracket is wholly located below said powerhead.

28. A marine propulsion arrangement comprising a transom bracket adapted to be fixed to the transom of a boat, a second bracket including a vertical leg having an upper end, a rearward surface extending below said upper end, and a lower end, and a lower leg fixedly extending rearwardly from said lower end of said vertical leg and having an outer rearward end spaced substantially from said lower end of said vertical leg and an upper surface extending forwardly from said rearward end and located substantially below said upper end of said second bracket, a tilt pin extending between said upper end of said second bracket and said transom bracket rearwardly of the transom so as to pivotally connect said second bracket and said transom bracket for tilting movement of said second bracket between a normal operating position and a raised tilt position and about a tilt axis which is generally horizontal when said transom bracket is fixed to the boat transom, a propulsion unit including a powerhead having a forward portion with front and bottom surfaces, and a lower unit secured to said powerhead rearwardly of said bottom surface of said forward portion of said powerhead and including a gearcase carrying a propulsion element, and means connecting said propulsion unit to said rearward end of said lower leg of said second bracket so as to enable steering movement of said propulsion unit relative to said second bracket about an axis transverse to the tilt axis, and such that said propulsion unit only pivots about the transverse axis with respect to said second bracket, and such that said front surface of said forward portion of said powerhead is located primarily below said tilt axis and in rearwardly spaced relation from said rearward surface of said vertical leg of said second bracket, and such that said bottom surface of said forward portion of said powerhead is located in upwardly spaced relation from said upper surface of said lower leg of said second bracket, and such that the totality of said means connecting said propulsion unit and said second bracket is wholly located below said powerhead.

29. An outboard motor comprising a transom bracket adapted to be fixed to the transom of a boat and having a generally flat mounting surface for engagement with the back of the transom, a unitary swivel bracket, a tilt pin directly pivotally connecting said transom bracket and said swivel bracket rearwardly of said mounting surface for tilting movement of said swivel bracket between a normal operating position and a raised tilt position and about a tilt axis which is generally horizontal when said transom bracket is fixed to the boat transom, a propulsion unit including a powerhead and lower unit rigidly secured to said powerhead, and means including a king pin located wholly below the tilt axis and connecting said propulsion unit to said swivel bracket so as to enable pivotal steering movement of said propulsion unit relative to said swivel bracket about an axis transverse to the tilt axis, and such that said propulsion unit only pivots about the transverse axis with respect to said swivel bracket, and such that said propulsion unit remains substantially rearwardly of said transom bracket mounting surface throughout movement of said swivel bracket from the normal operating position to the tilt position.

30. An outboard motor comprising a transom bracket adapted to be fixed to the transom of a boat and having a mounting surface for engagement with the transom, a swivel bracket including a vertical leg having an upper end, and a lower end, and a lower leg fixedly extending rearwardly from said lower end of said vertical leg, a tilt pin extending between said upper end of said swivel bracket and said transom bracket so as to pivotally connect said swivel bracket and said transom bracket for tilting movement of said swivel bracket between a normal operating position and a raised tilt position and about a tilt axis which is generally horizontal when said transom bracket is fixed to the boat transom, a propulsion unit including a powerhead and a lower unit rigidly secured to said powerhead, and means including a king pin located wholly below the tilt axis and connecting said lower unit below said powerhead and said lower leg of said swivel bracket so as to enable steering movement of said propulsion unit about an axis transverse to the tilt axis, and such that said propulsion unit only pivots about the transverse axis with respect to said swivel bracket, and such that said powerhead is located substantially wholly rearwardly of said tilt axis, and such that at least one-half of said powerhead is located below said tilt axis, and such that said propulsion unit remains substantially rearwardly of said transom bracket mounting surface throughout movement of said swivel bracket from the normal operating position to the tilt position.

31. An outboard motor comprising a transom bracket adapted to be fixed to the transom of a boat and having a mounting surface for engagement with the back of the transom, a unitary swivel bracket, a tilt pin directly pivotally connecting said swivel bracket and said transom bracket rearwardly of said mounting surface for tilting movement of said swivel bracket between a normal operating position and a raised tilt position and about a tilt axis which is generally horizontal when said transom bracket is fixed to the boat transom, a propulsion unit including a powerhead and a lower unit secured to said powerhead, and means including a king pin located below said powerhead and connecting said propulsion unit and said swivel bracket so as to enable steering movement of said propulsion unit about an axis transverse to the tilt axis, and such that said propulsion unit only pivots about the transverse axis with respect to said swivel bracket, and such that said powerhead is located substantially wholly rearwardly of said tilt axis, and such that at least one-half of said powerhead is located below said tilt axis, and such that said propulsion unit remains substantially rearwardly of said transom bracket mounting surface throughout movement of said swivel bracket from the normal operating position to the tilt position.

32. An outboard motor comprising a transom bracket adapted to be fixed to the transom of a boat and having a generally flat mounting surface for engagement with the back of the transom, a swivel bracket including a vertical leg having an upper end, a rearward surface extending below said upper end, and a lower end, and a lower leg fixedly extending rearwardly from said lower end of said vertical leg and having an outer rearward end spaced substantially from said lower end of said vertical leg and an upper surface extending forwardly from said rearward end and located substantially below said upper end of said swivel bracket, a tilt pin extending between said upper end of said swivel bracket and said transom bracket rearwardly of said mounting surface so as to pivotally connect said swivel bracket and said transom bracket for tilting movement of said swivel bracket between a normal operating position and a raised tilt position and about a tilt axis which is generally horizontal when said transom bracket is fixed to the boat transom, a propulsion unit including a powerhead having a forward portion with front and bottom surfaces, and a lower unit rigidly secured to said powerhead rearwardly of said bottom surface of said forward portion of said powerhead and including a gearcase, and means including a king pin located wholly below the tilt axis and connected to said propulsion unit between said powerhead and said gearcase and connected to said rearward end of said lower leg of said swivel bracket for pivotally connecting said propulsion unit and said swivel bracket so as to enable steering movement of said propulsion unit about an axis transverse to the tilt axis, and such that said propulsion unit only pivots about the transverse axis with respect to said swivel bracket, and such that said front surface of said forward portion of said powerhead is located primarily below the tilt axis and in rearwardly spaced relation from said rearward surface of said vertical leg of said swivel bracket, and such that said bottom surface of said forward portion of said powerhead is located in upwardly spaced relation from said upper surface of said lower leg of said swivel bracket, and such that said propulsion unit remains substantially rearwardly of the plane of said transom bracket mounting surface throughout movement of said swivel bracket from the normal operating position to the tilt position.

33. An outboard motor comprising a transom bracket adapted to be fixed to the transom of a boat, a unitary swivel bracket, a tilt pin directly pivotally connecting said swivel bracket and said transom bracket rearwardly of the transom for tilting movement of said swivel bracket relative to said transom bracket between a normal operating position and a raised tilt position and about a tilt axis which is generally horizontal when said transom bracket is fixed to the boat transom, a propulsion unit including a lower unit and a powerhead secured to said lower unit below the tilt axis, and means including a king pin located wholly below the tilt axis and connecting said propulsion unit and said swivel bracket for pivotal steering movement of said propulsion unit relative to said swivel bracket about an axis transverse to the tilt axis, and such that said propulsion unit only pivots about the transverse axis with respect to said swivel bracket.

34. An outboard motor comprising a transom bracket adapted to be fixed to the transom of a boat, a unitary swivel bracket, a tilt pin directly pivotally connecting said swivel bracket and said transom bracket rearwardly of the transom for tilting movement of said swivel bracket relative to said transom bracket between a normal operating position and a raised tilt position and about a tilt axis which is generally horizontal when said transom bracket is fixed to the boat transom, a propulsion unit including a powerhead and a lower unit secured to said powerhead, and means including a king pin located wholly below the tilt axis and connecting said propulsin unit and said swivel bracket so as to enable pivotal steering movement of said propulsion unit relative to said swivel bracket about an axis transverse to the tilt axis, and such that said propulsion unit only pivots about the transverse axis with respect to said swivel bracket.

35. An outboard motor comprisinng a transom bracket adapted to be fixed to the transom of a boat, a unitary swivel bracket, a tilt pin directly pivotally connecting said swivel bracket and said transom bracket rearwardly of the transom for tilting movement of said swivel bracket relative to said transom bracket between a normal operating position and a raised tilt position and about a tilt axis which is generally horizontal when said transom bracket is fixed to the boat transom, a propulsion unit including a powerhead and a lower unit secured to said powerhead, and means including a king pin located wholly below the tilt axis and connecting said lower unit and said swivel bracket so as to enable pivotal steering movement of said propulsion unit relative to said swivel bracket about an axis transverse to the tilt axis, and such that said propulsion unit only pivots about the transverse axis with respect to said swivel bracket.

36. An outboard motor comprising a transom bracket adapted to be fixed to the transom of a boat, a unitary swivel bracket, a tilt pin directly pivotally connecting said swivel bracket and said transom bracket rearwardly of the transom for tilting movement of said swivel bracket relative to said transom bracket between a normal operating position and a raised tilt position and about a tilt axis which is generally horizontal when said transom bracket is fixed to the boat transom, a propulsion unit including a powerhead and a lower unit secured to said powerhead, and means including a king pin located wholly below the tilt axis and directly connecting said propulsion unit and said swivel bracket so as to enable pivotal steering movement of said propulsion unit relative to said swivel bracket about an axis transverse to the tilt axis, and such that said propulsion unit only pivots about the transverse axis with respect to said swivel bracket.

37. An outboard motor comprising a transom bracket adapted to be fixed to the transom of a boat, a unitary swivel bracket, a tilt pin directly pivotally connecting said swivel bracket and said transom bracket rearwardly of the transom for tilting movement of said swivel bracket relative to said transom bracket between a normal operating position and a raised tilt position and about a tilt axis which is generally horizontal when said transom bracket is fixed to the boat transom, a propulsion unit including a powerhead and a lower unit secured to said powerhead, and means including a king pin located wholly below the tilt axis and connecting said propulsion unit and said swivel bracket so as to enable pivotal steering movement of said propulsion unit relative to said swivel bracket about an axis transverse to the tilt axis, and such that said propulsion unit only pivots about the transverse axis with respect to said swivel bracket, and such that at least one-half of said powerhead is located below the tilt axis when said swivel bracket is in a normal operating position.

38. A marine propulsion arrangement comprising a transom bracket adapted to be fixed to the transom of a boat, a second bracket including a vertical leg having an upper end and a lower end, and a lower leg fixedly extending rearwardly from said lower end of said vertical leg and having an outer rearward end spaced substantially from said lower end of said vertical leg, a tilt pin extending between said upper end of said second bracket and said transom bracket rearwardly of the transom so as to pivotally connect said second bracket and said transom bracket for tilting movement of said second bracket between a normal operating position and a raised tilt position and about a tilt axis which is generally horizontal when said transom bracket is fixed to the boat transom, a propulsion unit including a powerhead and a lower unit secured to said powerhead and including a gearcase carrying a propulsion element, and means including a king pin located wholly below the tilt axis and connecting said propulsion unit to said rearward end of said lower leg of said second bracket so as to enable steering movement of said propulsion unit relative to said second bracket about an axis transverse to the tilt axis, and such that said propulsion unit only pivots about the transverse axis with respect to said second bracket.

39. A marine propulsion arrangement comprising of a transom bracket adapted to be fixed to the transom of a boat, a second bracket including a vertical leg having an upper end and a lower end, and a lower leg fixedly extending rearwardly from said lower end of said vertical leg and having an outer rearward end spaced substantially from said lower end of said vertical leg, a tilt pin extending between said upper end of said second bracket and said transom bracket rearwardly of the transom so as to pivotally connect said second bracket and said transom bracket for tilting movement of said second bracket between a normal operating position and a raised tilt position and about a tilt axis which is generally horizontal when said transom bracket is fixed to the boat transom, a proulsion unit including a powerhead having a forward portion with front and bottom surfaces, and a lower unit secured to said powerhead rearwardly of said bottom surface of said forward portion of said powerhead and including a gearcase carrying a propulsion element, and means including a kin pin located wholly below the tilt axis and connecting said propulsion unit to said rearward end of said lower leg of said second bracket so as to enable steering movement of said propulsion unit relative to said second bracket about an axis transverse to the tilt axis, and such that said propulsion unit only pivots about the transverse axis with respect to said second bracket, and such that said front surface of said forward portion of said powerhead is located primarily below said tilt axis and in rearwardly spaced relation from said vertical leg of said second bracket and such that said bottom surface of said forward portion of said powerhead is located in upwardly spaced relation from said lower leg of said second bracket.

40. A marine propulsion arrangement comprising a transom bracket adapted to be fixed to the transom of a boat, a second bracket including a vertical leg having an upper end, a rearward surface extending below said upper end, and a lower end, and a lower leg fixedly extending rearwardly from said lower end of said vertical leg and having an outer rearward end spaced substantially from said lower end of said vertical leg and an upper surface extending forwardly from said rearward end and located substantially below said upper end of said second bracket, a tilt pin extending between said upper end of said second bracket and said transom bracket rearwardly of the transom so as to pivotally connect said second bracket and said transom bracket for tilting movement of said second bracket between a normal operating position and a raised tilt position and about a tilt axis which is generally horizontal when said transom bracket is fixed to the boat transom, a propulsion unit including a powerhead having a forward portion with front and bottom surfaces, and a lower unit secured to said powerhead rearwardly of said bottom surface of said forward portion of said powerhead and including a gearcase carrying a propulsion element, and means including a king pin located wholly below the tilt axis and connecting said propulsion unit to said rearward end of said lower leg of said second bracket so as to enable steering movement of said propulsion unit relative to said second bracket about an axis transverse to the tilt axis, and such that said propulsion unit only pivots about the transverse axis with respect to said second bracket, and such that said front surface of said forward portion of said powerhead is located primarily below said tilt axis and in rearwardly spaced relation from said rearward surface of said vertical leg of said second bracket, and such that said bottom surface of said forward portion of said powerhead is located in upwardly spaced relation from said upper surface of said lower leg of said second bracket.

* * * * *

REEXAMINATION CERTIFICATE (1469th)

United States Patent [19] [11] B1 4,355,986

Stevens [45] Certificate Issued May 21, 1991

[54] OUTBOARD MOTOR WITH ELEVATED HORIZONTAL PIVOT AXIS

[76] Inventor: Myron T. Stevens, Kenosha, Wis.

Reexamination Request:
No. 90/002,030, May 21, 1990

Reexamination Certificate for:

| | |
|---|---|
| Patent No.: | **4,355,986** |
| Issued: | **Oct. 26, 1982** |
| Appl. No.: | **159,480** |
| Filed: | **Jun. 16, 1980** |

[51] Int. Cl.[5] ..... B63H 21/26

[52] U.S. Cl. ..... 440/53; 248/640; 248/642

[58] Field of Search ..... 440/53, 63, 61

[56] References Cited

U.S. PATENT DOCUMENTS

| | | | |
|---|---|---|---|
| 2,119,281 | 5/1938 | Luders, Jr. | 440/53 |
| 2,138,600 | 11/1938 | Harmon | 248/641 |
| 2,739,561 | 3/1956 | Kiekhaefer | 440/55 |
| 4,177,747 | 12/1979 | Pichl | 248/642 |

*Primary Examiner*—Sherman D. Basinger

[57] ABSTRACT

Disclosed herein is an outboard motor comprising a transom bracket adapted to be fixed to a boat transom and having a generally flat mounting surface for engagement with the back of the transom, a swivel bracket, a pivot on the swivel bracket and on the transom bracket rearwardly of the mounting surface for pivotally connecting the swivel bracket and the transom bracket for tilting movement between a normal operating position and a raised tilt position and about a tilt axis which is generally horizontal when the transom bracket is fixed to the boat transom, a propulsion unit including a powerhead and a lower unit rigidly secured to the powerhead, and a pivot connected to the propulsion unit and located below the powerhead and connected to the swivel bracket for pivotally connecting the propulsion unit and the swivel bracket for steering movement about an axis transverse to the tilt axis and such that the propulsion unit remains rearwardly of the plane of the transom bracket mounting surface throughout movement of the swivel bracket from the normal operating position to the tilt position.

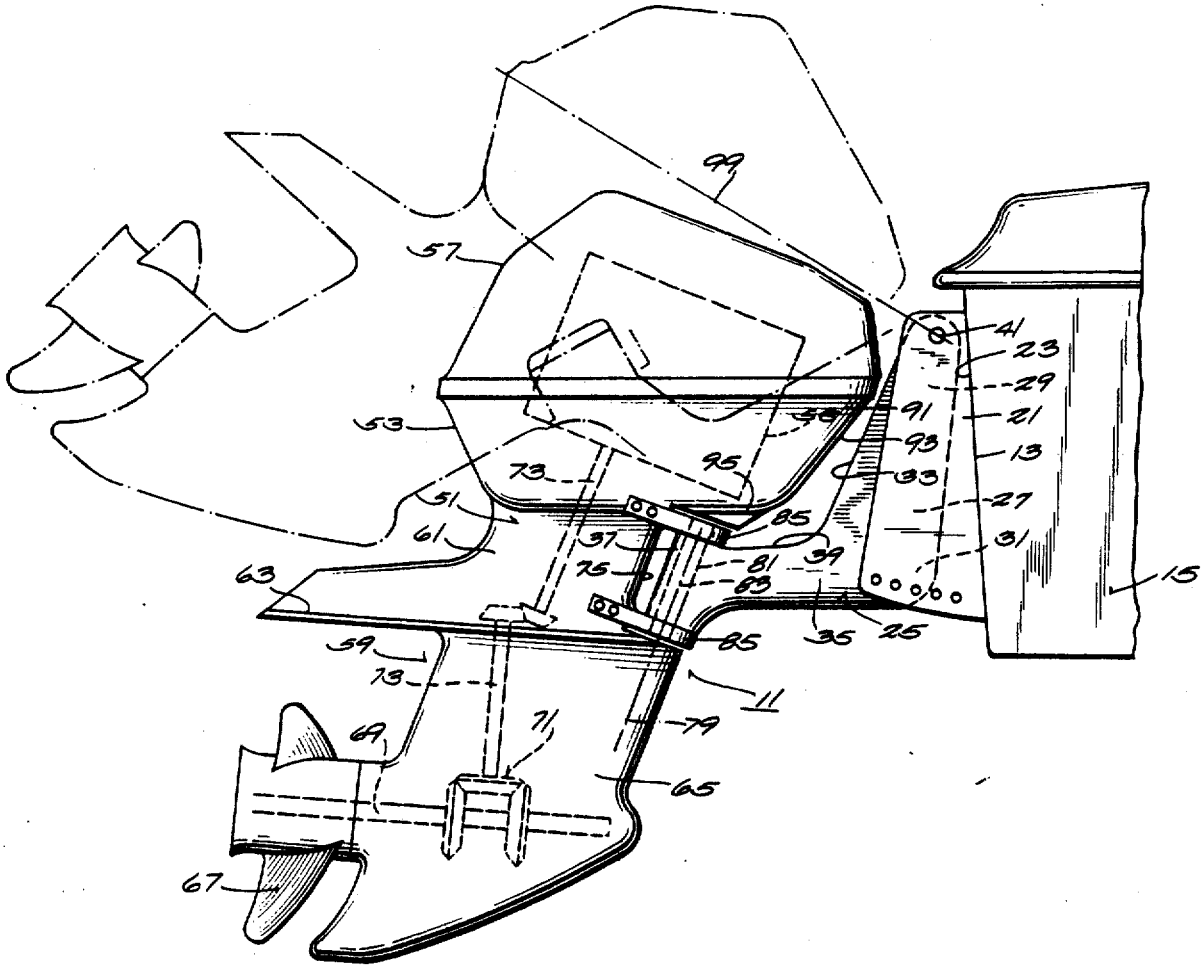

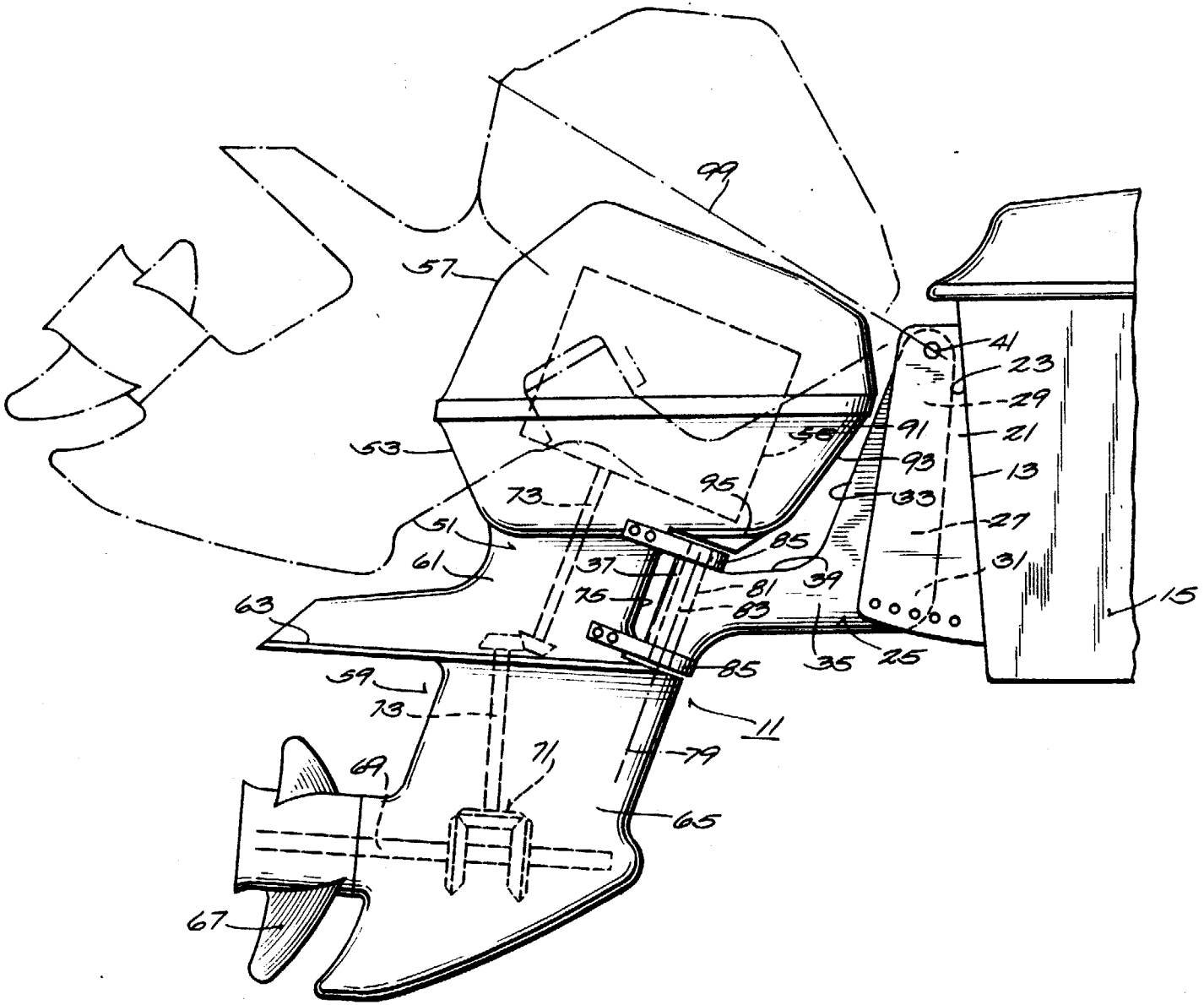
15
41
23
29
21
13
27
31
91
93
33
25
35
39
85
81
83
95
11
79
65
99
37
75
73
71
57
51
61
53
59
77
69
63
67

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–40 is confirmed.

New claims 41 and 42 are added and determined to be patentable.

*41. An outboard motor comprising a transom bracket adapted to be fixed to the transom of a boat and having a mounting surface for engagement with the back of the transom, a unitary swivel bracket, a tilt pin directly pivotally connecting said transom bracket and said swivel bracket rearwardly of said mounting surface for tilting movement of said swivel bracket between a normal operating position and a raised tilt position and about a tilt axis which is generally horizontal when said transom bracket is fixed to the boat transom, a propulsion unit including a powerhead and a lower unit secured to said powerhead, and means connecting said propulsion unit to said swivel bracket so as to enable pivotal steering movement of said propulsion unit relative to said swivel bracket about an axis transverse to the tilt axis, and such that said propulsion unit only pivots about the transverse axis with respect to said swivel bracket, and such that said propulsion unit remains substantially rearwardly of said transom bracket mounting surface throughout movement of said swivel bracket from the normal operating position to the tilt position, and such that the totality of said means connecting said propulsion unit and said swivel bracket is wholly located below the tilt axis throughout substantially the entire range of movement of said swivel bracket from the normal operating position to the tilt position.*

*42. An outboard motor comprising a transom bracket adapted to be fixed to the transom of a boat and having a mounting surface for engagement with the transom, an L-shaped swivel bracket including a vertical leg having an upper end, and a lower end, and a lower leg fixedly extending rearwardly from said lower end of said vertical leg, a tilt pin extending between said upper end of said swivel bracket and said transom bracket so as to pivotally connect said swivel bracket and said transom bracket for tilting movement of said swivel bracket between a normal operating position and a raised tilt position and about a tilt axis which is generally horizontal when said transom bracket is fixed to the boat transom, a propulsion unit including a powerhead and a lower unit secured to said powerhead, and means connecting said lower unit and said lower leg of said swivel bracket so as to enable steering movement of said propulsion unit about an axis transverse to the tilt axis, and such that said propulsion unit only pivots about the transverse axis with respect to said swivel bracket and such that said powerhead is located substantially wholly rearwardly of said tilt axis, and such that at least one-half of said powerhead is located below said tilt axis, and such that said propulsion unit remains substantially rearwardly of said transom bracket mounting surface throughout movement of said swivel bracket from the normal operating position to the tilt position, and such that the totality of said means connecting said propulsion unit and said swivel bracket is wholly located below the tilt axis.*

* * * * *